US011440724B2

(12) United States Patent
Fidler

(10) Patent No.: US 11,440,724 B2
(45) Date of Patent: Sep. 13, 2022

(54) CONTAINER WITH NESTED RESERVOIRS FOR SIMULTANEOUS CONTENT DELIVERY

(71) Applicant: IN-CAN LLC, Hilo, HI (US)

(72) Inventor: Robert Lawrence Fidler, Pepeekeo, HI (US)

(73) Assignee: IN-CAN LLC, Hilo, HI (US)

( * ) Notice: Subject to any disclaimer, the term of this patent is extended or adjusted under 35 U.S.C. 154(b) by 0 days.

(21) Appl. No.: 17/490,968

(22) Filed: Sep. 30, 2021

(65) Prior Publication Data

US 2022/0017283 A1 Jan. 20, 2022

Related U.S. Application Data

(63) Continuation of application No. PCT/US2020/066458, filed on Dec. 21, 2020.

(60) Provisional application No. 62/953,585, filed on Dec. 26, 2019.

(51) Int. Cl.

| | |
|---|---|
| ***B65D 81/32*** | (2006.01) |
| ***B65D 1/16*** | (2006.01) |
| ***B65D 51/28*** | (2006.01) |

(52) U.S. Cl.

CPC ..... *B65D 81/3227* (2013.01); *B65D 1/165* (2013.01); *B65D 51/28* (2013.01); *B65D 2205/02* (2013.01)

(58) Field of Classification Search

CPC .... B65D 81/3227; B65D 1/165; B65D 51/28; B65D 2205/02; B65D 81/3216; B65D 81/3222; B65D 81/3255; B65D 81/3266; B65D 17/4012; B65D 2517/0014; B65D 2517/0056

USPC ..... 206/219–222, 568; 215/6, DIG. 8; 220/255, 255.1, 256.1, 257.1, 258.1, 270

See application file for complete search history.

(56) References Cited

U.S. PATENT DOCUMENTS

| | | | | |
|---|---|---|---|---|
| 3,779,372 | A | 12/1973 | de Lloret | |
| 4,221,291 | A | 9/1980 | Hunt | |
| 5,215,214 | A * | 6/1993 | Lev | B65D 81/3216 220/502 |
| 5,217,433 | A * | 6/1993 | Bunin | A61J 1/2093 206/221 |
| 6,363,978 | B2 * | 4/2002 | Castillo | B65D 51/28 141/100 |
| 8,875,926 | B2 * | 11/2014 | Grajqevci | B65D 17/4014 220/253 |

(Continued)

FOREIGN PATENT DOCUMENTS

| | | | |
|---|---|---|---|
| JP | 2014-125277 | A | 7/2014 |

*Primary Examiner* — J. Gregory Pickett
*Assistant Examiner* — Jenine Pagan
(74) *Attorney, Agent, or Firm* — Seed Intellectual Property Law Group LLP

(57) ABSTRACT

A liquid storage and dispensing device having at least two internal reservoirs to store two discrete liquids and to dispense the two liquids through a single opening without mixing the liquids until exiting the single opening, the device including a container to store a first liquid and a first reservoir mounted under the lid of the container that stores a second liquid, and an opening mechanism on the top that creates a pour opening in the top and removes a seal from the first reservoir to enable simultaneous dispensing of the first and second liquids through the pour opening while maintaining separation of the first and second liquids until they exit the pour opening.

9 Claims, 9 Drawing Sheets

(56) References Cited

U.S. PATENT DOCUMENTS

| | | | | |
|---|---|---|---|---|
| 2007/0241114 | A1* | 10/2007 | Roberts | B65D 25/08 220/524 |
| 2009/0272747 | A1* | 11/2009 | Kalaouze, Jr. | B65D 81/3222 220/500 |
| 2010/0224511 | A1 | 9/2010 | Boatner | |
| 2017/0349330 | A1* | 12/2017 | Roberts | B65D 25/08 |
| 2018/0327142 | A1 | 11/2018 | Nikolic | |
| 2019/0322425 | A1* | 10/2019 | Beery | B65D 51/2878 |

* cited by examiner

CONTAINER WITH NESTED RESERVOIRS FOR SIMULTANEOUS CONTENT DELIVERY

BACKGROUND

Technical Field

The present disclosure pertains to containers for storing and delivering liquid materials and, more particularly, to a container that stores discrete multiple liquids and provides for simultaneous delivery without mixing the liquids until they exit a pour opening.

DESCRIPTION OF THE RELATED ART

In an effort to provide convenience to consumers, producers of beverage products will premix two or more liquids into a single container. This avoids having to purchase two separate products in two containers and having to mix them at or prior to the time of consumption of the beverages. This issue also arises when two or more liquid-based products must be based prior to use, such as a hardener and a compound to be set by the hardener. Various designs have been proposed to enable the storage and dispensing of multiple liquids from a single container that may be compartmentalized. This approach creates issues at the design and manufacturing stage. In addition, in some cases it is important that the two liquids maintain separation up to the point of exit from the container. Many designs cause the liquids to be mixed inside the original container upon opening, which in some cases is undesirable.

BRIEF SUMMARY

The present disclosure is directed to a container and method of making that stores multiple liquids and maintains separation of the liquids until the liquids are dispensed from the container.

In one aspect of the present disclosure, a liquid storage and dispensing device is provided that includes at least two internal reservoirs to store two discrete liquids and to dispense the two liquids through a single opening without mixing the liquids until they exit the single opening. The device includes a container to store a first liquid in the interior of the container and a first reservoir mounted under the lid in the interior of the container that stores a second liquid without mixing the second liquid with the first liquid. The device further includes an opening mechanism on a top of the container that creates a pour opening in the top and removes a seal from the first reservoir to enable simultaneous dispensing of the first and second liquids through the pour opening while maintaining separation of the first and second liquids until they exit the pour opening.

In accordance with another aspect of the present disclosure, a single chamber reservoir is mounted inside a container and is opened by the normal action of opening the container, allowing the delivery of multiple liquids to the consumer to be mixed outside of the interior of the container and preferably in the mouth of the consumer.

Other implementations may feature multiple chambers within the internal reservoir allowing for additional discreet liquids to be dispensed. Alternatively, variable sized drain or vent openings or both are provided to enable a more metered rate of flow when dispensing the contents of a chamber within the reservoir.

In accordance with another implementation of the present disclosure, an interior container is placed inside an exterior container and contains a secondary liquid product that compliments a first product stored discretely in the exterior container, and access to both containers is realized simultaneously by utilizing the mechanical function of the existing tab mechanism located in the lid of the exterior container. By opening the existing mechanism tab function, this downward motion peels off an aluminum foil seal exposing openings in the interior container that will allow the vacuum to be broken and allow the secondary liquid product to flow out of the openings separately until exiting the opening of the exterior container.

The separation of the liquids is maintained until exiting the actual point of dispensing. This separation of the two liquids will preserve the highest of qualities of each liquid until the point of use.

In accordance with one aspect of the present disclosure, a multi-chambered storage and dispensing device for storing and dispensing liquid is provided. The device includes a container having at least one sidewall with an exterior, and a bottom, the sidewall and the bottom structured to cooperate to define an interior of the container; a top sized and shaped to attach to the container and enclose the interior of the container, the top having an opening mechanism that creates a pour opening in the top that is in fluid communication with the interior of the container; a first reservoir depending from the top in the interior of the container, the first reservoir having a wall and a lid on the wall that cooperate to form a sealed first chamber in the first reservoir, the first reservoir including a dispensing opening in the wall that is in fluid communication with the first chamber, and a vent opening in the wall in fluid communication with the first chamber; and a seal that is structured to removably attach to the wall of the first reservoir and is sized and shaped to cover the dispensing opening and the vent opening, the seal structured to partially peel away from the wall of the first reservoir to uncover the vent opening and the dispensing opening in response to the opening mechanism creating the pour opening in the top.

In accordance with another aspect of the foregoing implementation, the dispensing opening in the first reservoir is positioned adjacent the opening mechanism so that liquid dispensed from the dispensing opening mixes with liquid exiting the pour opening only outside of the interior of the container and does not mix in the interior of the container.

In accordance with yet another aspect of the foregoing implementation, the seal that covers the dispensing opening and the vent opening is structured to remain attached to the wall of the first reservoir as the seal is partially peeled away from the wall of the first reservoir to uncover the dispensing opening and vent opening.

In accordance with still yet another aspect of the foregoing implementation, the device includes a second chamber in the first reservoir, the second chamber having a dispensing opening and a vent opening, and the seal is structured to cover the dispensing opening and the vent opening in the second chamber, the seal configured to also uncover the dispensing opening and the vent opening in the second sealed chamber in response to the opening mechanism creating a pour opening in the top.

In accordance with yet a further aspect of the foregoing implementation, the device includes a second reservoir depending from the top in the interior of the container, the second reservoir having a wall and a lid on the wall forming a second chamber in the second reservoir, the second reservoir including a dispensing opening in fluid communication with the second chamber and a vent opening in fluid communication with the second chamber, and the seal is structured to also cover the dispensing opening and the vent opening in the second reservoir, the seal structured to partially peel away to uncover the dispensing opening and vent opening in the second reservoir as well as the dispensing opening and vent opening in the first reservoir in response to the opening mechanism creating an opening in the top.

In accordance with another implementation of the present disclosure, a device for storing and dispensing at least a first liquid and a second liquid is provided. The device includes a container having an exterior and an interior, and at least one sidewall and a bottom that are structured to define the interior, the interior capable of storing the first liquid; a top on the container to enclose the interior of the container, the top having an exterior surface and an interior surface and a ring pull opening mechanism on the exterior surface that is structured to create a pour opening in the top that is in fluid communication with the interior of the container, the ring pull opening mechanism operable to bend a scored portion of the top into the interior of the first container to form the pour opening; a first reservoir on the interior side of the top, the first reservoir having a wall and a lid on the wall forming a first chamber in the reservoir, the reservoir including a dispensing opening in fluid communication with the first sealed chamber; and a removable seal structured to cover the dispensing opening, the seal sized and shaped to be positioned adjacent the scored portion on the top and to be contacted by the scored portion of the top when the scored portion of the top is bent into the interior of the container and to be partially removed from the first reservoir sufficiently to uncover the dispensing opening while remaining attached to the first reservoir in response to the scored portion of the top bending into the interior of the container.

In accordance with another aspect of the foregoing implementation, the dispensing opening in the first reservoir is sized and shaped to be positioned adjacent the scored portion of the top so that the first liquid poured through the pour opening in the top from the interior of the container and the second liquid dispensed through the dispensing opening in the first reservoir, simultaneous with the pouring of the first liquid, will mix together only on the exterior of the container.

In accordance with yet another aspect of the foregoing implementation, the device includes a vent opening formed in the first reservoir and wherein the seal is structured to cover the vent opening in addition to the dispensing opening and the seal is further structured to uncover the vent opening in addition to the dispensing opening in response to the scored portion of the top forming the pour opening in the top.

In accordance with yet another aspect of the foregoing implementation, the device includes a second chamber in the first reservoir, the second chamber having a dispensing opening and a vent opening, the seal sized and shaped to also cover the dispensing opening and the vent opening in the second chamber, the seal configured to cooperate with the scored portion of the top to also uncover the dispensing opening and the vent opening in the second sealed chamber in response to contact from the scored portion of the top, and wherein the dispensing opening in the second chamber is positioned adjacent the scored portion of the top so that the first liquid poured through the pour opening in the top, the second liquid dispensed through the dispensing opening in the first chamber, and a third liquid dispensed through the dispensing opening in the second chamber mix together only on the outside of the container.

In accordance with yet a further aspect of the foregoing implementation, the device includes a second reservoir depending from the interior surface of the top in the interior of the container, the second reservoir having a wall and a lid on the wall forming a second chamber in the second reservoir, the second reservoir including a dispensing opening in fluid communication with the second chamber and a vent opening in fluid communication with the chamber, the seal sized and shaped to also cover the dispensing opening and the vent opening in the second chamber in the second reservoir, the seal further configured to cooperate with the scored portion of the top to also uncover the dispensing opening and the vent opening in the second reservoir in response to contact from the scored portion of the top, and wherein the dispensing opening in the second reservoir is positioned adjacent the scored portion of the top so that the first liquid poured through the pour opening in the top, and the second liquid dispensed through the dispensing opening in the first reservoir, and a third liquid dispensed through the dispensing opening in the second reservoir mix together only on the outside of the container.

In accordance with a further aspect of the present disclosure, a device for storing and dispensing at least a first liquid and a second liquid is provided. The device includes a container having an exterior and an interior, the interior capable of storing the first liquid; a top on the container, the top having an exterior surface, an opposing interior surface, and an opening mechanism on the exterior surface of the top, the top further including a scored portion, and the opening mechanism comprising a ring operable to bend the scored portion of the top into the interior of the first container to form a pour opening in the top to be in fluid communication with the interior of the container; a first reservoir having a sidewall with a top edge, a bottom wall on the sidewall, and a sealable lid structured to be attached to the top edge of the sidewall to form a first chamber in the reservoir capable of storing the second liquid, the first reservoir further including a dispensing opening formed in the sidewall adjacent the top edge and a vent opening formed in the sidewall adjacent the top edge, the dispensing opening and the side opening in fluid communication with the first chamber, the first reservoir sized and shaped to be attached to the interior side of the top adjacent the scored portion and without covering the scored portion of the top; and a seal structured to be removably adhered to the sidewall of the first reservoir and sized and shaped to cover the dispensing opening and the vent opening, the seal structured to be positioned on the first reservoir adjacent to the scored portion of the top and to be contacted by the scored portion of the top when the scored portion of the top is bent into the interior of the first container and to be partially removed from the first reservoir sufficiently to uncover the dispensing opening while remaining attached to the first reservoir in response to bending of and contact by the scored portion of the top.

In accordance with another aspect of the foregoing implementation, the dispensing opening in the first reservoir is structured to be positioned adjacent to the pour opening when the pour opening is formed in the top so that the first liquid poured from the interior of the container through the pour opening and the second liquid dispensed from the first reservoir through the dispensing opening, simultaneous with the first liquid being poured through the pour opening, will mix together only on the exterior of the container.

In accordance with another aspect of the foregoing implementation, the opening mechanism is structured to create a vent opening in the top prior to creating the pour opening in the top to reduce pressure in the interior of the container.

In accordance with yet another aspect of the foregoing implementation, the device includes a second chamber in the first reservoir, the second chamber having a dispensing opening and a vent opening that are covered by the seal, the seal configured to cooperate with the scored portion of the top to also uncover the dispensing opening and the vent opening in the second chamber in response to contact from the scored portion of the top, and wherein the dispensing opening in the second sealed chamber is positioned adjacent the scored portion of the top so that the first liquid poured through the pour opening in the top, the second liquid dispensed through the dispensing opening in the first chamber, and a third liquid dispensed through the dispensing opening in the second chamber mix together only on the outside of the container.

In accordance with still yet another aspect of the foregoing implementation, the device includes a second reservoir depending from the interior surface of the top in the interior of the container, the second reservoir having a wall and a lid structured to be attached to the wall to form a second chamber in the second reservoir, the second reservoir including a dispensing opening in fluid communication with the second chamber and a vent opening in fluid communication with the chamber, the seal configured to cooperate with the scored portion of the top to also uncover the dispensing opening and the vent opening in the second reservoir in response to contact from the scored portion of the top, and wherein the dispensing opening in the second reservoir is positioned adjacent the scored portion of the top so that the first liquid poured through the pour opening in the top and the second liquid dispensed through the dispensing opening in the first reservoir, and a third liquid dispensed through the dispensing opening in the second reservoir mix together only on the outside of the interior of the container.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
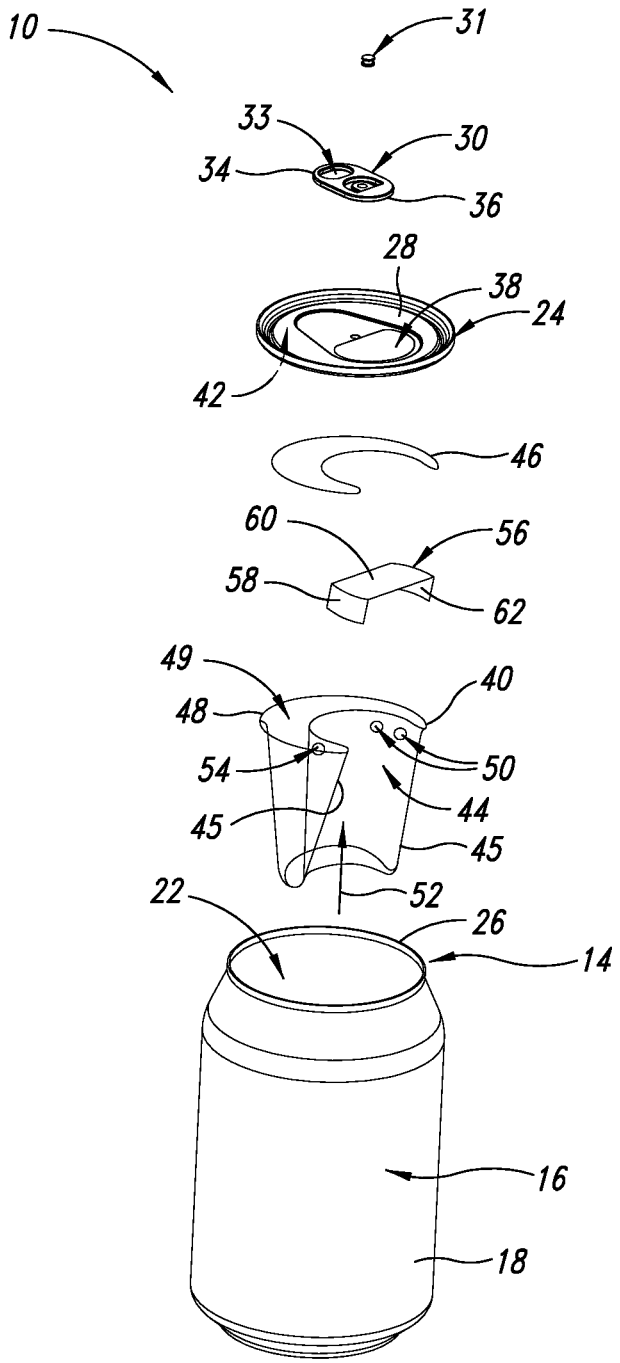
FIG. 1 is an exploded view of a multiple nested sealed container formed in accordance with one implementation of the present disclosure.
Figure 2A:
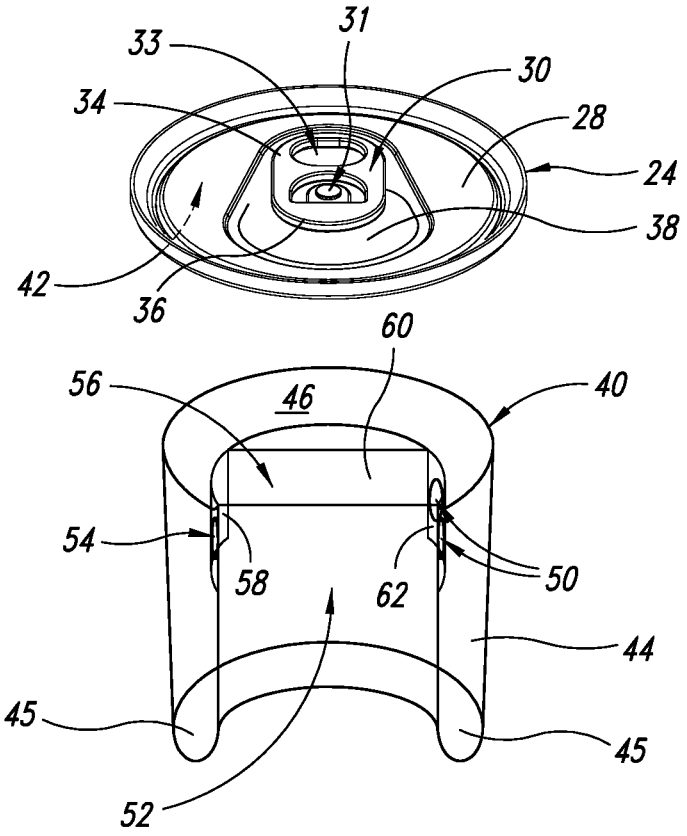
FIGS. 2A and 2B illustrate an exploded view and assembled view of the first reservoir and top, respectively, of the container of FIG. 1.
Figure 2B:
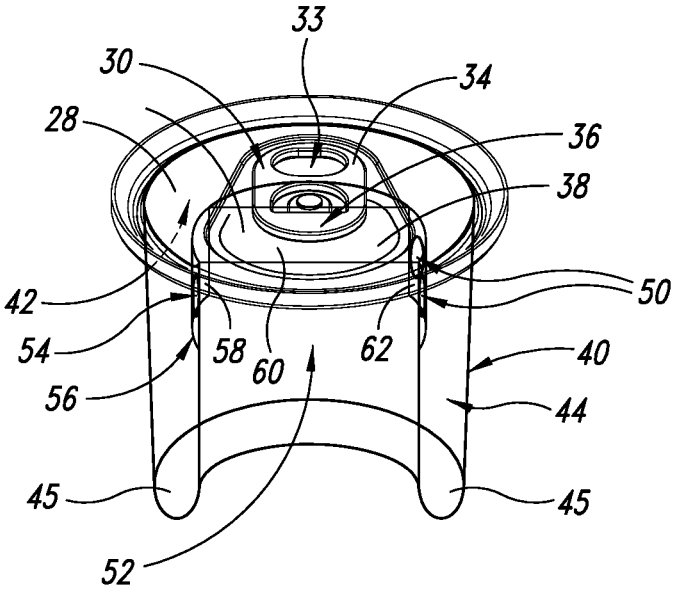
Figure 3A:
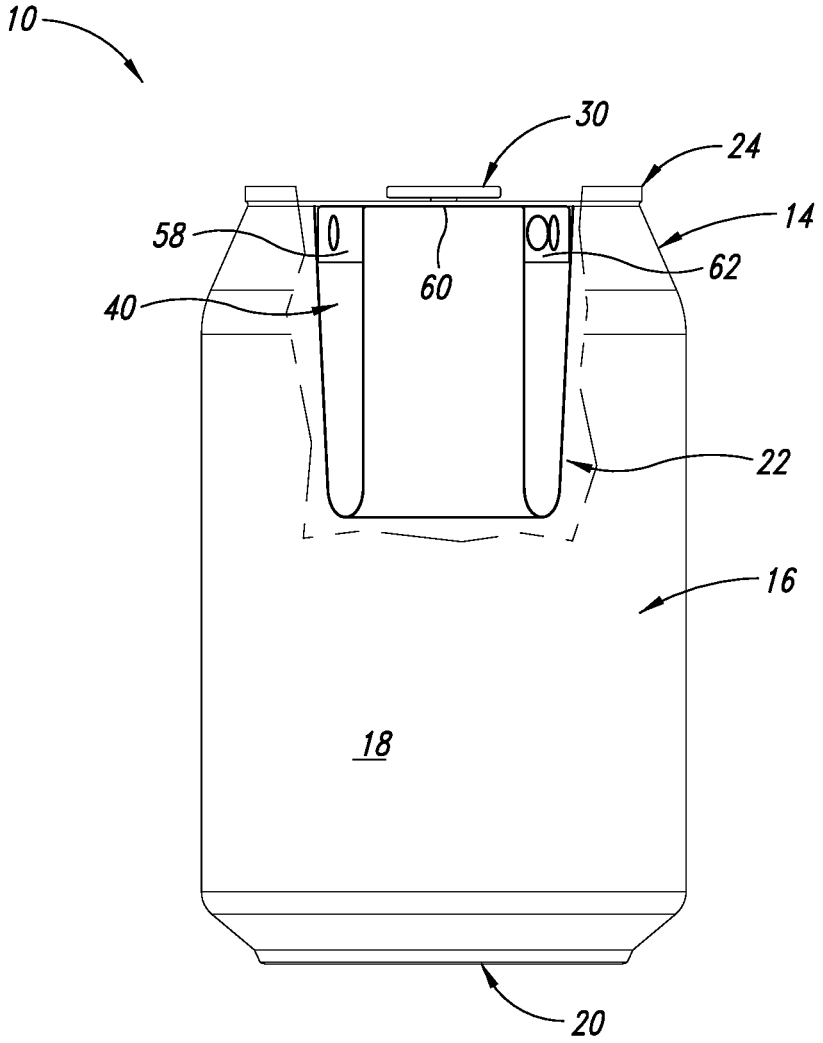
FIGS. 3A-3E are partial cut-away front elevational views illustrating the steps of using the container of FIGS. 1 and 2 in accordance with the present disclosure.
Figure 3B:
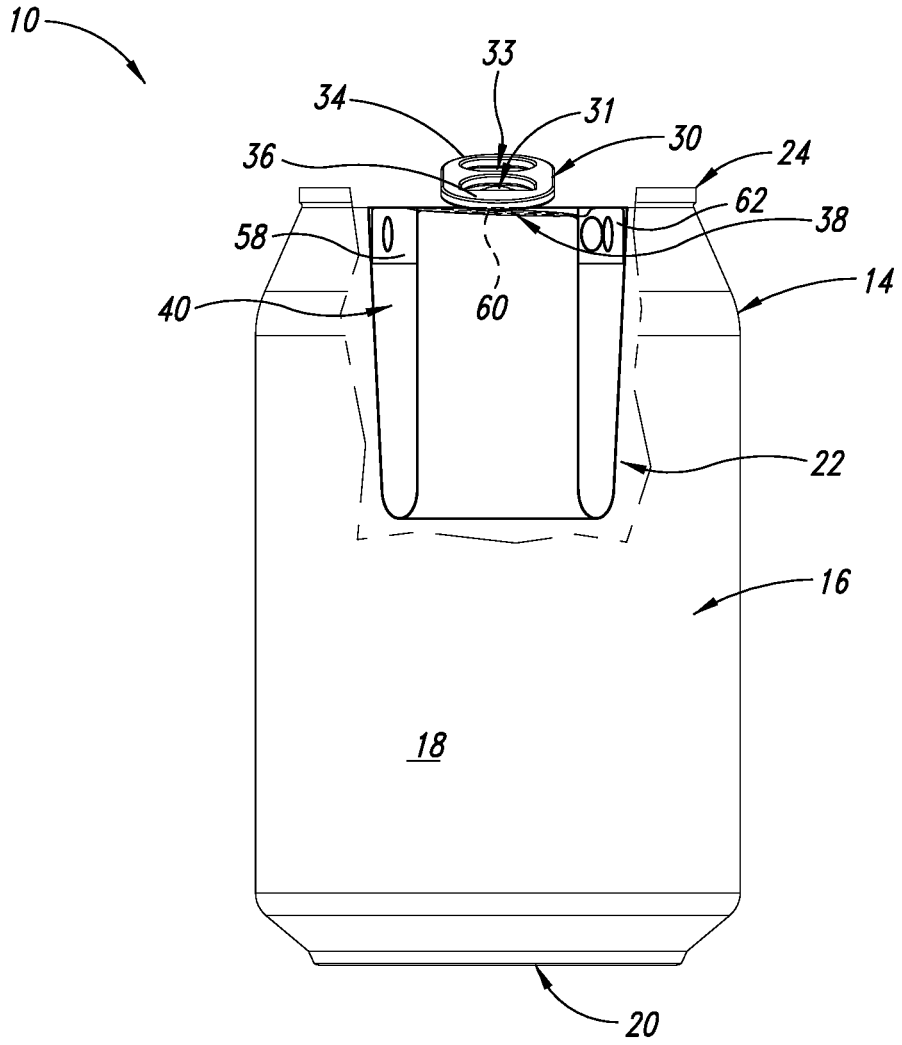
Figure 3C:
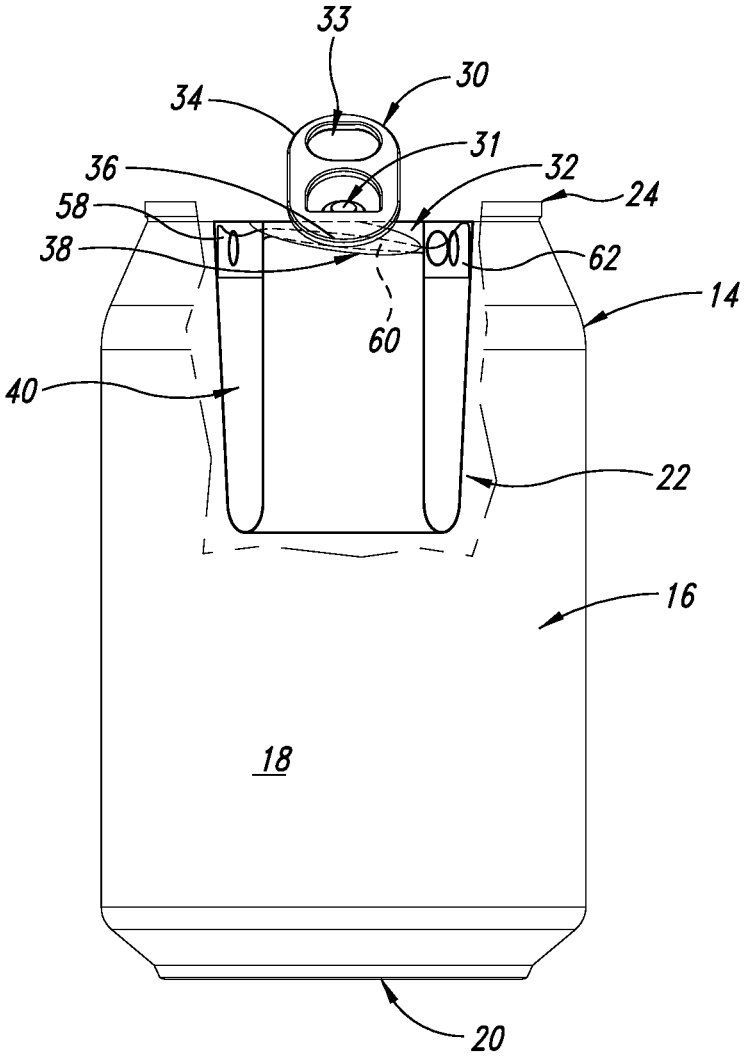
Figure 3D:
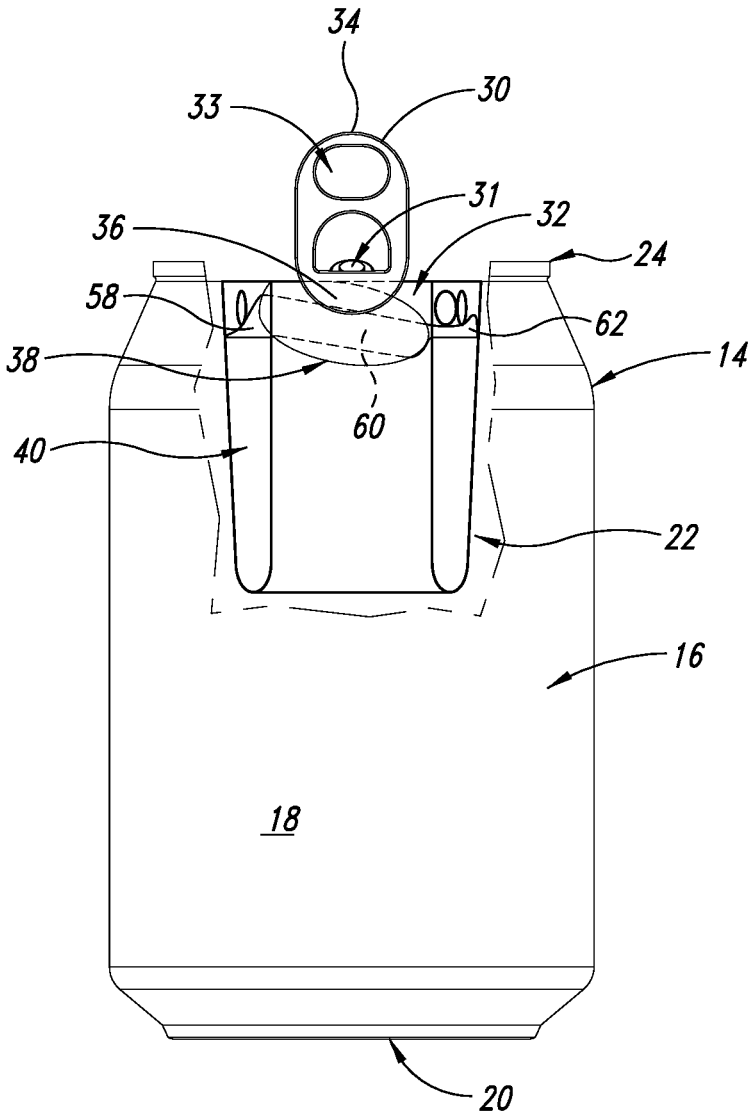
Figure 3E:
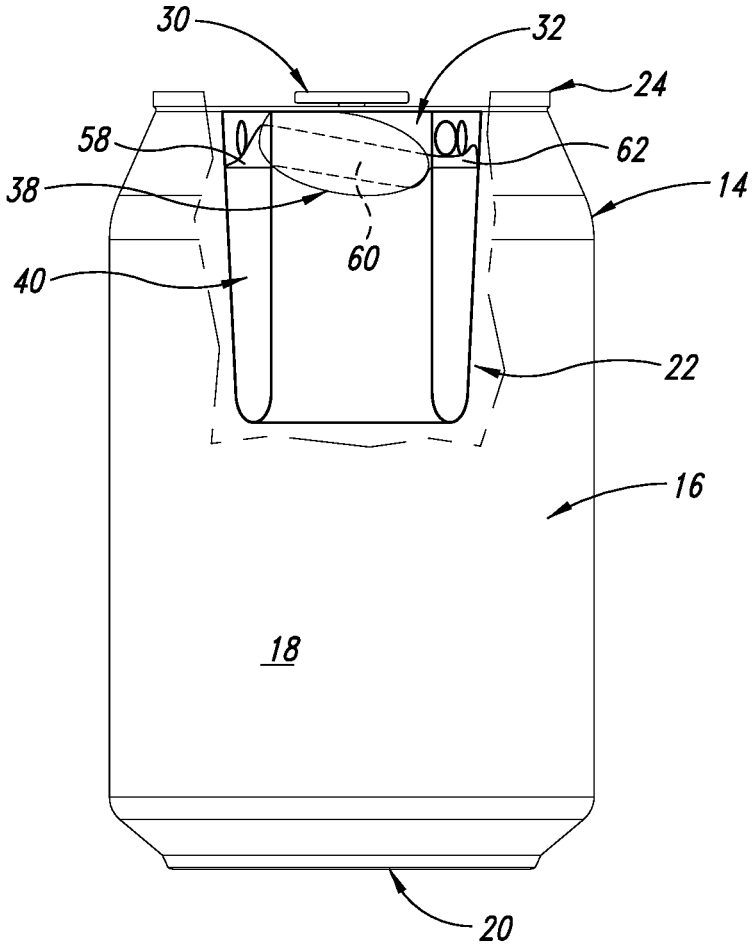

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with drink cans, sta-tab and retained ring-pull opening mechanisms, as well as pressurized drink can design and manufacture have not been shown or described in detail to avoid unnecessarily obscuring descriptions of the implementations.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one implementation" or "an implementation" means that a particular feature, structure or characteristic described in connection with the implementation is included in at least one implementation. Thus, the appearance of the phrases "in one implementation" or "in an implementation" in various places throughout this specification are not necessarily all referring to the same implementation. Furthermore, the particular features, structures, or characteristics may be combined in any suitable manner in one or more implementations. It will be appreciated that for simplicity and clarity of illustration, where considered appropriate, reference numerals may be repeated among the figures to indicate corresponding or analogous elements or steps.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the implementations.

GENERAL OVERVIEW

The present disclosure is designed primarily for use with drink and liquid storage and dispensing containers having liquid stored therein under some amount of pressure. These containers are typically opened using a pull ring that is retained on the top of the container. The consumer lifts one end of the pull ring to cause a scored section of the top to separate, creating an access opening to the liquid in the container. U.S. Pat. No. 4,030,631 entitled Easy-open Ecology End describes a retained ring-pull opening mechanism that is in use today. The mechanism operates initially as a class 2 lever by using a lifting action at one end of the ring, such as by a consumer's finger. A rivet that attaches the middle of the ring to the top creates an initial vent opening in the top in response to the first upward movement of the ring that pulls on the rivet.

As a result, the initial rupture in the top by the rivet creates a vent opening to release any pressure inside the can that could resist the second step of pushing a portion of the top downward to the interior of the can. As the ring continues its upward motion, the nose of the ring pushes down on a portion of the can top surrounded by a score line. The ring remains attached to the top as the nose of the ring pushes the scored section downward to form a pour opening. As described in the '631 patent, "The panel formed on rupture of the score line is forced downwardly in response to continued lifting of the tab which now acts as a class 1 lever in urging the panel downwardly by rupturing the remainder of the score line to form a pour opening. Again, the operation of the tab as a class 1 lever does not depend on rupture of a secondary or separate vent score. Since the panel is urged downwardly through the opening which forms the pour opening, the traditional separable tear strip is eliminated, thereby further reducing a potential source of litter, the severed tear strip."

Container Description

In accordance with one aspect of the present disclosure, a multi-chambered storage and dispensing device 10 for storing and dispensing multiple liquids is provided, which is illustrated in FIGS. 1-4B. As seen more clearly in the exploded view of FIG. 1, the device 10 includes a container 14 having at least one sidewall 16 with an exterior 18, and a bottom 20, the sidewall 16 and the bottom 20 structured to cooperate to define an open-top interior 22 of the container 14. The container 14 is structured to receive a top 24 sized and shaped to attach to the container 14 and enclose the interior 22. The top 24 is sealingly attached to a terminal edge 26 of the side wall 16, which enables storing of a liquid A (shown in FIGS. 4A-4B under pressure in the interior 22 of the container 14.

The top 24 has an exposed exterior surface 28 with an opening mechanism 30 attached thereto by a rivet 31 that creates a pour opening 32 (see, e.g., FIG. 3D) in the top 24 that is in fluid communication with the interior 22 of the container 14. This type of opening mechanism 30 is well known and readily commercially available and will not be described in detail herein. Briefly, the sequence of using the opening mechanism 30 will be described in conjunction with FIGS. 3A-3E. The opening mechanism 30 has an opening 33 in a first end 34 sized and shaped to receive a consumer's fingertip. The consumer 70 (shown in FIGS. 4A-4B) pulls up on the first end 34 of the opening mechanism 30 using the opening 33. As the mechanism 30 is pulled upward, the rivet 31 creates an opening in the top 24 that vents any pressure in the interior 22 of the container 14. As the consumer 70 continues pulling upward on the mechanism 30, an opposing second end 36 pushes on the exterior surface 28 of the top 24 in an area 38 that is scored or otherwise weakened. The pressure from the second end 36 pushes the scored area 38 away and into the interior 22 of the container 14 while leaving a portion of the scored area 38 attached to the top 24. This creates the pour opening 32 in the top 24. The consumer 70 then pushes the first end 34 of the opening mechanism 30 back to its original position, moving it out of the way of the pour opening 32 and leaving the top 24 unobstructed for drinking through the pour opening 32.

A first reservoir 40 depends from an interior surface 42 of the top 24 in the interior 22 of the container 14. The first reservoir 40 has a sidewall 44 and a lid 46 on a top edge 48 of the sidewall 44 that cooperate to form a sealed first chamber 49 in the first reservoir 40. In use, the lid 46 is affixed to the interior surface 42 of the top 24 using conventional means, such as adhesive, which is readily commercially available and will not be described in detail herein. The attachment is sufficiently strong to keep the first reservoir 40 attached to the top 24 during the opening process described herein below.

The first reservoir 40 includes at least one, and in this implementation, two dispensing openings 50 in the sidewall 44 that are in fluid communication with the first chamber 49. Each dispensing opening 50 is formed in the sidewall to be just below the top edge 48 of the sidewall 44. Each dispensing opening 50 is sized and shaped to enable a fluid or liquid B (shown in FIGS. 4A-4B) stored in the first chamber 49 to exit the first reservoir through the dispensing opening 50. In this implementation, each opening is shown to have a circular shape, although it is to be understood that other shapes may be used as well, such as square, rectangular, triangular, and other geometric shapes.

As can be seen in the Figures, the first reservoir 40 has a C-shaped plan form configuration that creates a half-pipe shaped valley 52 having a circular cross-sectional shape that varies in radius along its length in the sidewall 44. The valley 52 can have other geometric cross-sectional shapes that must be sized and shaped to provide clearance or spacing for and to accommodate the scored area 38 that later becomes a flap that folds into the valley 52 when the container 14 is opened. The dispensing openings 50 are formed in the portion of the sidewall 44 that forms the valley 52 and are located horizontally along the sidewall to be adjacent each other. However, they may be located on opposite sides of the valley 52, so long as they are in close proximity to the top edge 48 to enable the liquid B in the first sealed chamber 49 to dispense therefrom as the container 14 is initially tipped from a vertical orientation to an orientation that brings the dispensing openings below a surface of the liquid so that liquid exits the dispensing openings 50 by force of gravity. Each dispensing opening 50 is preferably located in the valley 52 near an outside corner 45 of the valley 52 to enable it to be sealed as discussed more fully below.

To facilitate the dispensing of the liquid B from the first chamber 49 of the first reservoir 40, at least one vent opening 54 is formed in the sidewall 44 of the first reservoir 40 that is in fluid communication with the first chamber 49. Each vent opening 54 can have almost any shape, such as the circular shape shown in the drawings. Most importantly, each vent opening 54 is positioned on the sidewall 44 in the valley 52 a distance to the top edge 48 of the sidewall 44 that is shorter than a distance of each dispensing opening 50 to the top edge 48 of the sidewall. This distancing ensures that air will be able to enter the first chamber 49 simultaneous with the liquid B exiting each dispensing opening 50 and without the liquid B exiting the vent opening 54. In addition, each vent opening 54 is positioned in the valley 52 near an outside corner or ridge 45 of the valley 52 to enable each vent opening 54 to be sealed as discussed more fully below.

A seal 56 is structured to removably attach to the sidewall 44 of the first reservoir 40 in the valley 52, and it is sized and shaped to cover each dispensing opening 50 and the vent opening 54. The seal 56 is structured to partially peel away from the sidewall 44 of the first reservoir 40 in response to actuation of the opening mechanism 30 to uncover each vent opening 54 and each dispensing opening 50, thus creating the pour opening 32 in the top 24 as described more fully below.

In the preferred implementation, the seal 56 has a substantially rectangular shape. It has a length and width sufficient to have a first leg 58 to extend down a portion of the sidewall 44 on one interior side of the valley 52, a center portion 60 to extend across the valley 52, and a second leg 62 to extend down the interior of the sidewall 44 on the other side of the valley 52 so that each dispensing opening 50 and each vent opening 54 are covered by a respective leg 58, 62. In addition, the center portion 60 of the seal 56 is positioned immediately below the scored area 38 on the top 24. It may be attached to the underside of the scored area 38 to ensure positive response to movement of the scored area 38 during the opening process described below.

As shown in FIGS. 3A-3E, when the scored area 38 is pushed into the interior 22 of the container 14 by the opening mechanism 30, the scored area 38 becomes a flap that pushes the center portion 60 of the seal 56 downward and peels the respective first and second legs 58, 62 away from the sidewall 44 to uncover each dispensing opening 50 and each vent opening 54. Because the seal 56 is attached to the scored area 38, it will not fall into the first liquid A stored in the interior 22 of the container 14.

The seal 56, the first reservoir 40 with its lid 46, as well as the container 14 and its top 24 with opening mechanism 30 are all made from food grade materials. The first reservoir 40 may be made of a food grade plastic and the lid 46 may be made of foil or suitable plastic material. Preferably the seal 56 is made from a foil material, such as PET coated foil that is pre-stamped and can hold its shape. During manufacture, the first reservoir 40 has the seal 56 placed on the sidewall 44 prior to introducing the liquid B to the first interior chamber 49. The reservoir 40 is covered by the lid 46 after it is filled with the liquid B. It is then attached to the interior side 42 of the top 24, after which the top 24 is applied to the top edge 26 of the container 14.

Figure 4A:
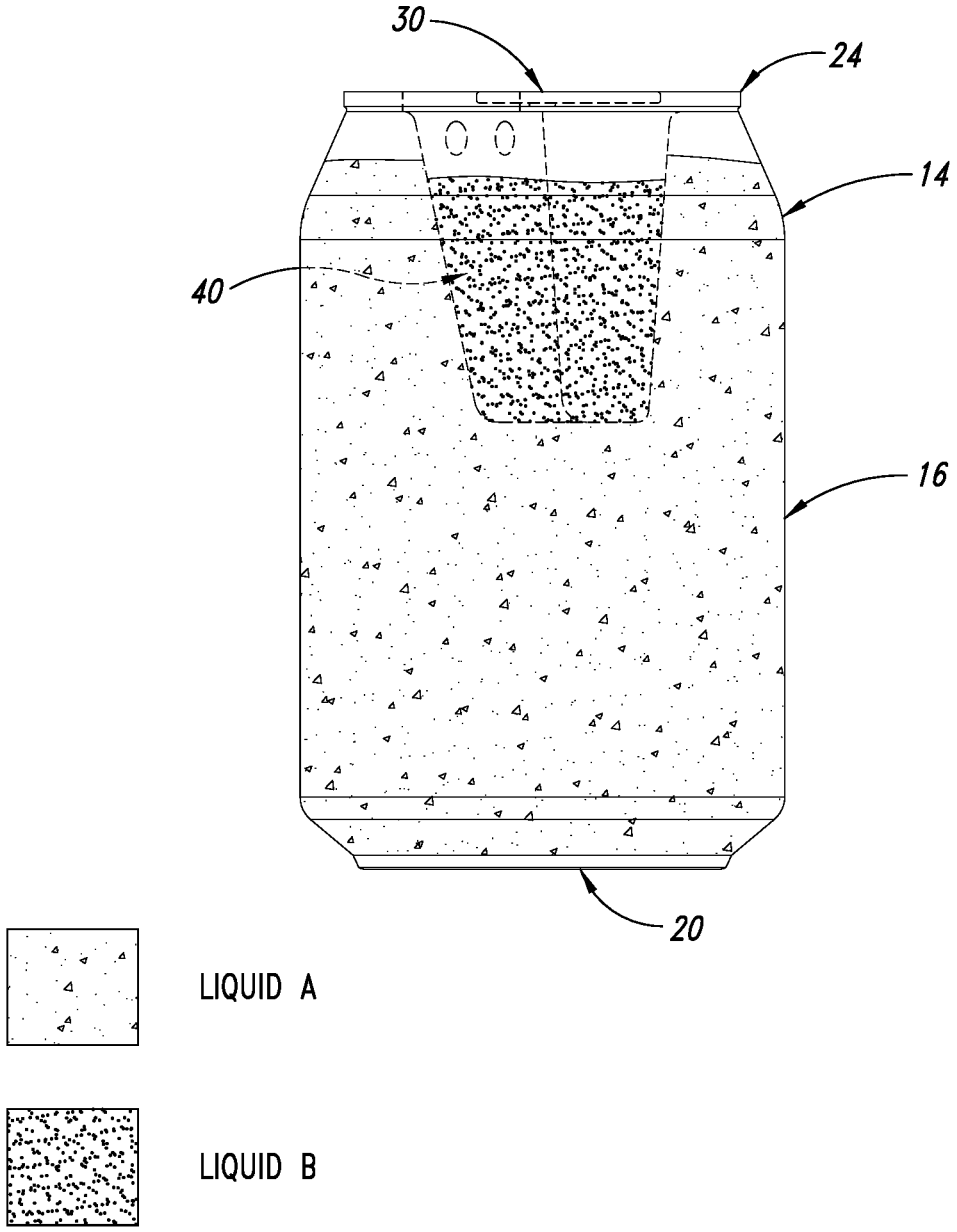
FIGS. 4A and 4B are side views illustrating the discrete storing of two liquids and the dispensing of the two liquids through a single pour opening, respectively.
Figure 4B:
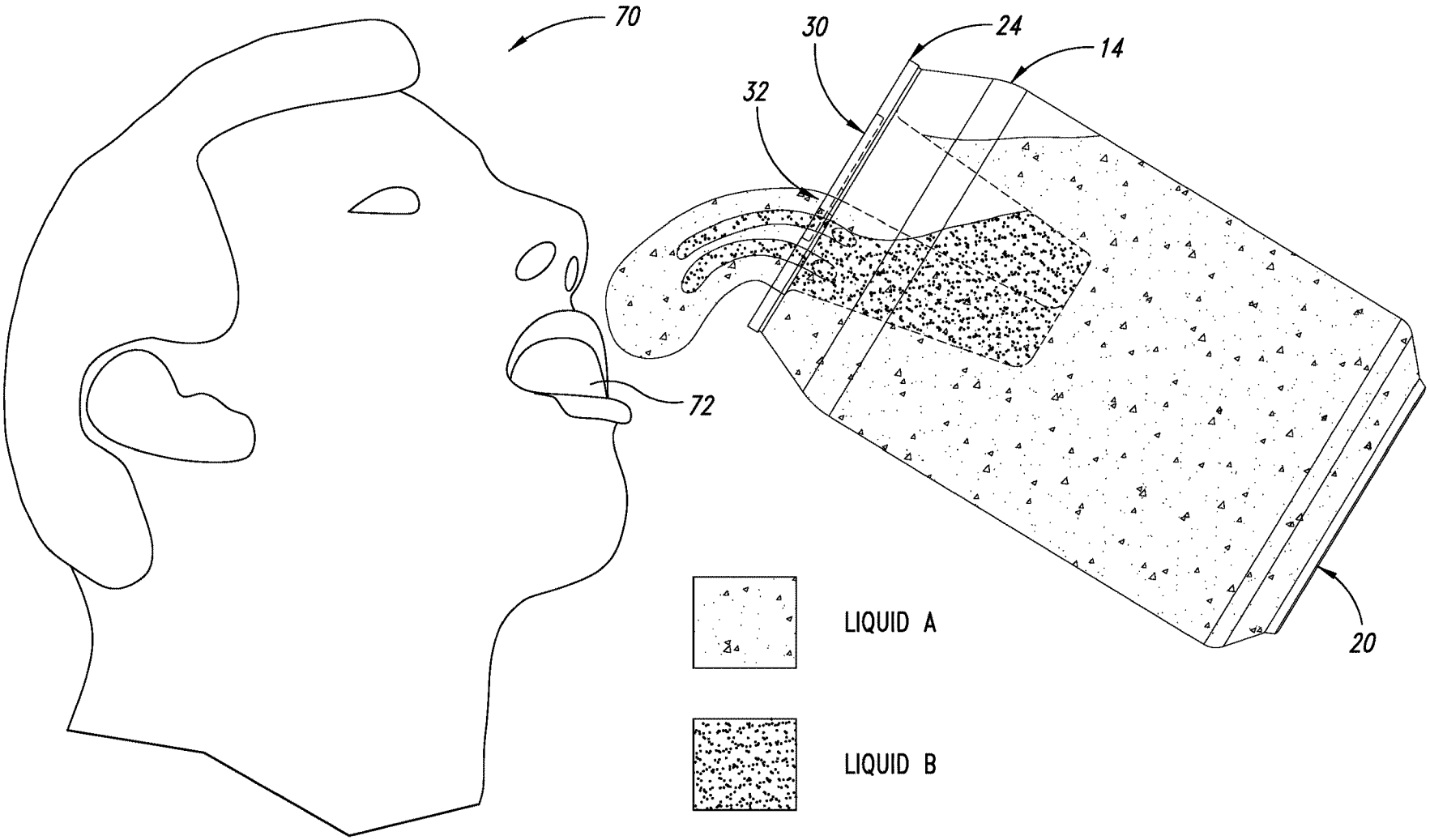

In use, once the opening mechanism 30 is used to open the top 24 to create the pour opening 32 and to uncover each dispensing opening 50 and each vent opening 54, the consumer 70 can hold the container 14 and tip it sideways as shown in FIGS. 4A-4B to enable liquid A to exit the interior 22 of the container 14 and the liquid B exits the first reservoir 40 via each dispensing opening 50. The two liquids A and B maintain separation until they exit the pour opening 32, where they mix together in the mouth 72 of the consumer 70.

It is to be understood that various changes can be made to the disclosure to enhance its utility. For example, the first reservoir 40 can be sized and shaped to have more than one interior chamber, with each chamber storing its own liquid and having its own dispensing and vent openings that are all covered by the same seal. Alternatively, multiple reservoirs can be positioned on the top 24 in the interior 22 of the container 14, each with its own seal that is peeled back by the scored area 38 in the top 24 as it is opened. It is to be understood that the containers and reservoirs described herein can take the form of a metal or plastic container, a flexible container or bladder, or a combination of thereof.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet including U.S. Provisional Patent Application No. 62/953,585, filed on Dec. 26, 2019, are incorporated herein by reference, in their entirety. Aspects of the embodiments can be modified, if necessary to employ concepts of the various patents, applications and publications to provide yet further embodiments.

The invention claimed is:

1. A multi-chambered storage and dispensing device for storing and dispensing liquid, comprising:

a container having at least one sidewall with an exterior, and a bottom, the sidewall and the bottom structured to cooperate to define an interior of the container;

a top sized and shaped to attach to the container and enclose the interior of the container, the top having only one opening mechanism that creates a single pour opening in the top that is in fluid communication with the interior of the container;

a first reservoir depending from the top in the interior of the container, the first reservoir having a wall and a lid on the wall that cooperate to form a sealed first chamber in the first reservoir, the first reservoir including a dispensing opening in the wall that is in fluid communication with the first chamber, and a vent opening in the wall in fluid communication with the first chamber; and a seal that is attached to the opening mechanism and structured to adhesively attach to the wall of the first reservoir, the seal sized and shaped to cover the dispensing opening and the vent opening, the seal structured to at least partially peel away from the wall of the first reservoir to uncover the vent opening and the dispensing opening in response to the opening mechanism creating the pour opening in the top while remaining attached to the opening mechanism.

2. The device of claim 1 wherein the dispensing opening in the first reservoir is positioned adjacent the opening mechanism so that liquid dispensed from the dispensing opening mixes with liquid exiting the pour opening only outside of the interior of the container and does not mix in the interior of the container.

3. The device of claim 1 wherein the seal that covers the dispensing opening and the vent opening is structured to remain partially attached to the wall of the first reservoir as the seal is partially peeled away from the wall of the first reservoir to uncover the dispensing opening and vent opening.

4. A device for storing and dispensing at least a first liquid and a second liquid, the device comprising:

a container having an exterior and an interior, and at least one sidewall and a bottom that are structured to define the interior, the interior capable of storing the first liquid;

a top on the container to enclose the interior of the container, the top having an exterior surface and an interior surface and only one ring pull opening mechanism on the exterior surface that is structured to create a single pour opening in the top that is in fluid communication with the interior of the container, the top having a scored portion and the ring pull opening mechanism operable to bend the scored portion of the top into the interior of the container to form the pour opening;

a first reservoir on the interior side of the top, the first reservoir having a wall and a lid on the wall forming a first chamber in the reservoir, the reservoir wall including a dispensing opening in fluid communication with the first chamber; and a removable seal attached to the scored portion and adhesively attached to the first reservoir wall to cover the dispensing opening, the seal sized and shaped to be at least partially peeled off the first reservoir sufficiently to uncover the dispensing opening while remaining attached to the scored portion first reservoir in response to the scored portion of the top bending into the interior of the container.

5. The device of claim 4 wherein the dispensing opening in the first reservoir is sized and shaped to be positioned adjacent the scored portion of the top so that the first liquid poured through the pour opening in the top from the interior of the container and the second liquid dispensed through the dispensing opening in the first reservoir, simultaneous with the pouring of the first liquid, will mix together only on the exterior of the container.

6. The device of claim 4 further comprising a vent opening formed in the first reservoir and wherein the seal is structured to cover the vent opening in addition to the dispensing opening and the seal is further structured to uncover the vent opening in addition to the dispensing opening in response to the scored portion of the top forming the pour opening in the top.

7. A device for storing and dispensing at least a first liquid and a second liquid, the device comprising:

a container having an exterior and an interior, the interior capable of storing the first liquid;

a top on the container, the top having an exterior surface, an opposing interior surface, and an opening mechanism on the exterior surface of the top, the top further including a scored portion, and the opening mechanism comprising only one ring operable to bend the scored portion of the top into the interior of the container to form a single pour opening in the top to be in fluid communication with the interior of the container;

a first reservoir having a sidewall with a top edge, a bottom wall on the sidewall, and a sealable lid structured to be attached to the top edge of the sidewall to form a first chamber in the reservoir capable of storing the second liquid, the first reservoir further including a dispensing opening formed in the sidewall adjacent the top edge and a vent opening formed in the sidewall adjacent the top edge, the dispensing opening and the side opening in fluid communication with the first chamber, the first reservoir sized and shaped to be attached to the interior side of the top adjacent the scored portion and without covering the scored portion of the top; and a seal attached to the scored portion of the top and adhesively attached to the first reservoir to cover the dispensing opening and the vent opening, the seal structured to be at least partially peeled away from the first reservoir sufficiently to uncover the dispensing opening while remaining attached to the scored portion in response to bending of the scored portion of the top into the interior of the first container.

8. The device of claim 7 wherein the dispensing opening in the first reservoir is structured to be positioned adjacent to the pour opening when the pour opening is formed in the top so that the first liquid poured from the interior of the container through the pour opening and the second liquid dispensed from the first reservoir through the dispensing opening simultaneous with the first liquid being poured through the pour opening will mix together only on the exterior of the container.

9. The device of claim 7 wherein the opening mechanism is structured to create a vent opening in the top prior to creating the pour opening in the top to reduce pressure in the interior of the container.

* * * * *